US005855220A

United States Patent [19]

Wu

[11] Patent Number: 5,855,220

[45] Date of Patent: Jan. 5, 1999

[54] FLATTENED FOLDING UMBRELLA

[76] Inventor: Tsun-Zong Wu, F8, NO76, LN103, SEC2, Nei-Hu Rd, Taipei, Taiwan

[21] Appl. No.: 904,719

[22] Filed: Aug. 1, 1997

[51] Int. Cl.[6] ..... A45B 11/00

[52] U.S. Cl. ..... 135/20.1; 135/31

[58] Field of Search ..... 135/22, 24, 20.1, 135/31, 29, 32, 25.3, 25.31

[56] References Cited

U.S. PATENT DOCUMENTS

| | | | |
|---|---|---|---|
| 1,405,824 | 2/1922 | Evans | 135/29 |
| 1,405,911 | 2/1922 | Fretz, Sr. | 135/29 |
| 1,417,491 | 5/1922 | Brandt | 135/29 |
| 1,469,495 | 10/1923 | Bunker | 135/29 |
| 1,474,821 | 11/1923 | Hartzell | 135/29 |
| 3,593,731 | 7/1971 | Schultes | 135/29 |
| 3,837,352 | 9/1974 | Weber | 135/20.1 |
| 4,658,844 | 4/1987 | Ping | 135/29 |
| 5,337,770 | 8/1994 | Wang | 135/29 |
| 5,533,535 | 7/1996 | Lin et al. | 135/20.1 |
| 5,615,697 | 4/1997 | Lin et al. | 135/20.1 |

*Primary Examiner*—Lanna Mai

[57] ABSTRACT

A flattened folding umbrella, having two sets of terminal rib devices and four sets of side rib devices, each rib device comprising of inside main rib, middle main rib, outside main rib, branch rib, inside connecting rib, middle connecting rib, middle joint, and outside joint that are mutually joined together, wherein each set of terminal rib device is formed by compressing an appropriate location of the originally U-shaped groove of the branch rib to form a stop of narrow-opening groove to prevent the inside connecting rib that is joined to said branch rib from being accommodated in said branch rib, so that when the umbrella is folded, relatively the outside terminal of said inside connecting rib and its connected middle joint are inclining slightly outwardly; besides, the outside terminal of said inside connecting rib is also designed to have a larger outward inclining obtuse angle, or an appropriate location of the U-shaped groove of the middle main rib is compressed to form a stop of narrow-opening groove, so that when the umbrella is folded, it will prevent the inside main rib from being accommodated into said middle main rib, and that relatively, the outside terminal of said middle main rib and its connected outside joint are inclining slightly outwardly; therefore, it reduces the installation thickness of the terminal joining component; and that when the umbrella is folded, it naturally forms the configuration that the outside joint of each side rib device is located on the inside, and the outside joint of each terminal rib device is naturally located at the outside, to become a more narrowed and flattened shape.

2 Claims, 6 Drawing Sheets

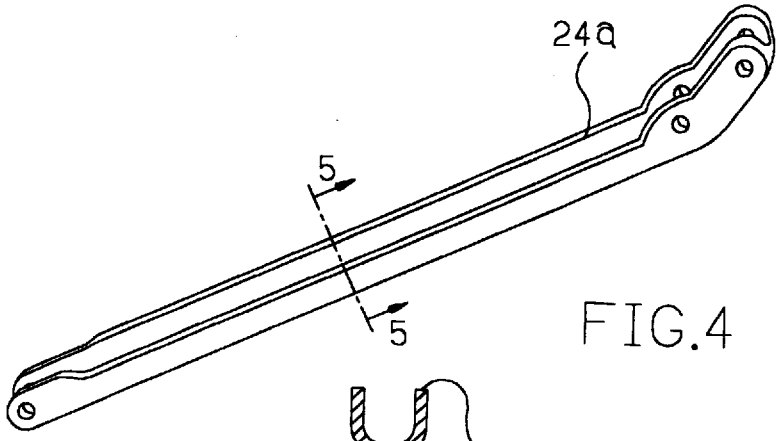
FIG.4
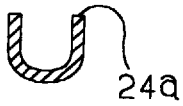
FIG.5
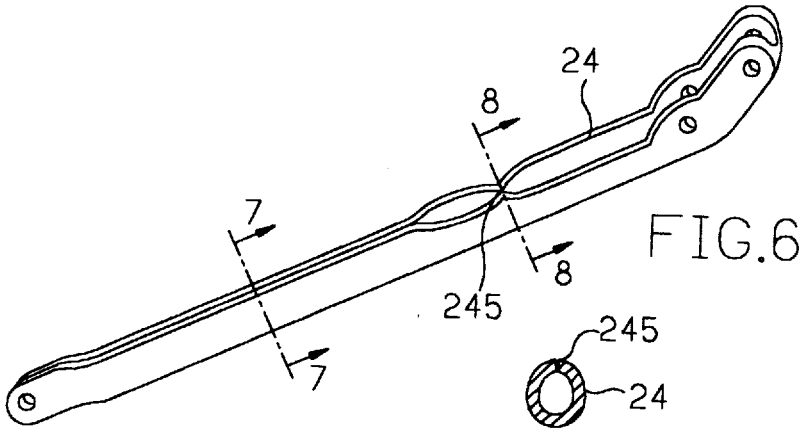
FIG.6
FIG.8
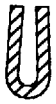
FIG.7

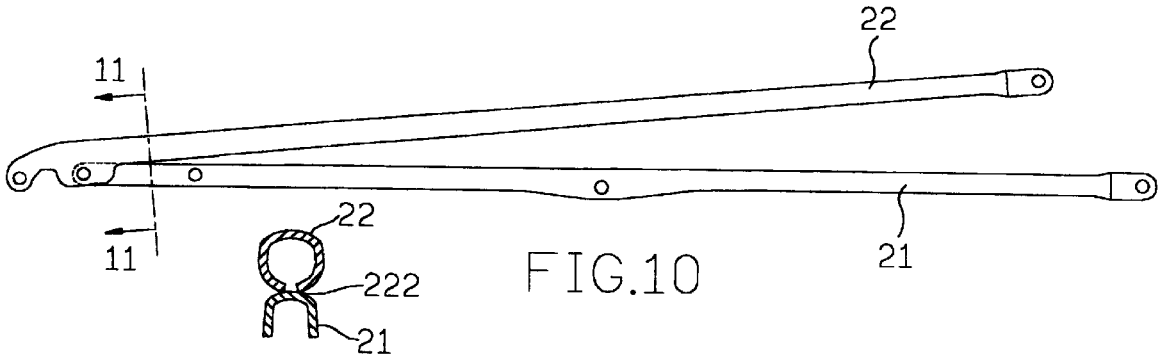
FIG.10
FIG.11
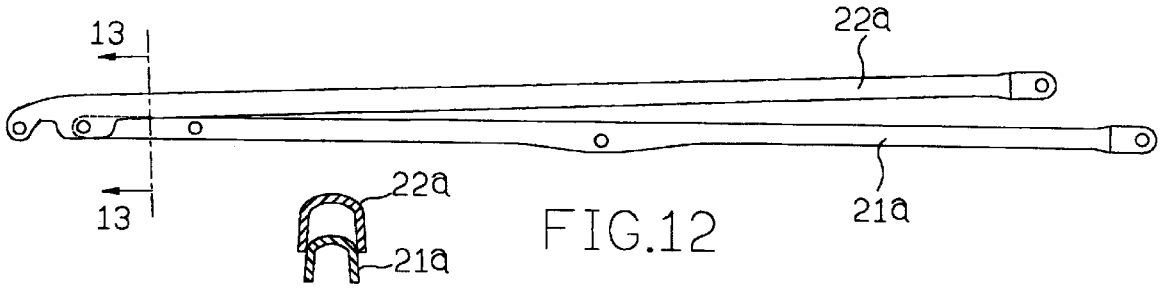
FIG.12
FIG.13

FLATTENED FOLDING UMBRELLA

BACKGROUND OF THE INVENTION

The present invention relates to a flattened folding umbrella configuration, with improvement on the rib configuration, so that when the umbrella is folded, the whole body is naturally narrowed to become a flattened folding umbrella.

U.S. Pat. No. 5,615,697 provides a type of "POCKETABLE FOLDING UMBRELLA WITH FOLDABLE SANDWICHED RIBS", comprising mainly of: on top of the center rod (1) is fixed with a flat upper ferrule (3) which has a flat plate (31); said flat plate serves to define a long axis (X) on two extremities (E), and define a short axis (Y) between two sides (S); on the bottom of the flat plate (31) of said upper ferrule (3) on the two extremities (E) are each fitted with a terminal joining component (32) extending outward crosswise along the long axis (X), to join the inside of the inside main rib (21) of each terminal rib device (2); on the bottom of the flat plate (31) of said upper ferrule (3) near the sides (S) are each fitted with a side inclining wall (33); between each side inclining wall (33) and each terminal joining component (32) is joined to each side rib device (2*a*), with an upper tying thread (35) pulling through the inside of the inside main rib (21*a*) of each side rib device (2*a*), and through the inside of each terminal joining component (32); so that after the umbrella is folded, the outside joint (28*a*) of each side rib device (2*a*) can be located at the two sides of the terminal joining component (32); while the outside joint (22) of the terminal rib device (2) is located at the outward crosswise position of the terminal joining component (32), to avoid mutual overlapping of the outside joints of respective rib devices, to narrow it to become a flattened form.

However, the above prior art of flat folding umbrella, when it is folded, has the following occurrence that it could not achieve a properly flattened form. Referring to FIG. 1, the outside joint (28*a*) of each side rib device (2*a*) is joined by a bolt (284*a*) to the outside of the middle connecting rib (26*a*), while each terminal joining component (32) is joined by a bolt (321) to the inside of the inside main rib (21) of each terminal rib device (2); therefore, the joint of each bolt is especially enlarged; however, after said prior art is folded, the outside joint (28*a*) of each side rib device (2*a*) must be close to the upper ferrule (3) direction, but because said outside terminal and the upper ferrule (3) cannot be completely near, since there must be room to accommodate the fabric (5) after the umbrella is folded, therefore, the outside joint (28*a*) of each side rib device (2*a*), including its joining bolt (284*a*) is overlapped with the bolt (321) of each terminal joining component (32), resulting in especially enlarged width (W') of the overlapped portion; so it is impossible to achieve narrowing function and flattened form after it is folded.

Furthermore, referring to FIG. 2, in said prior art, each terminal rib device (2) is installed on the outside of the terminal joining component (32) protruding crosswise on the upper ferrule (3), while each side rib device (2*a*) is directly installed on the upper ferrule (3); suppose the crosswise length of the terminal joining component (32) is L1, and the length of each rib device is L, then, after the fold is opened, the horizontal extension length at the position of each rib device (2*a*) is L, and the horizontal extension length at the position of each terminal rib device (2) is L+L=L', therefore, in said prior art, after the umbrella is opened, the horizontal extension length of each terminal side device (2) and each side rib device (2*a*) is not consistent; and relatively, the fabric (5) tied to each rib device becomes non-equilateral polygons, thus resulting in uneven appearance of the umbrella; and the tensile strength of the fabric at each rib position is inconsistent, so the tightness on the fabric surface is uneven.

SUMMARY OF THE INVENTION

To effectively improve the above weaknesses, the present invention has been specially designed to entirely exclude the installation of crosswise protruding terminal joining component, to effectively improve the rib configuration.

In the present invention, the construction of each side rib device is like a prior art, but the installation of each terminal rib device is so designed that in the rib configuration of mutually joined inside main rib, middle main rib, branch rib, inside connecting rib, middle connecting rib, middle joint and outside joint, an appropriate location of the originally U-shaped groove of the branch rib is compressed to form a stop of narrow-opening groove, so that the inside connecting rib joined to said branch rib cannot be accommodated inside said branch rib; that when the umbrella is folded, relatively, the outside of said inside connecting rib and its connected middle joint are inclining slightly outwardly; besides, the outside of said inside connecting rib is also designed to include a larger outward inclining obtuse angle, or the appropriate location of originally U-shaped groove of the middle main rib is compressed to form a stop of narrow-opening groove, so that when the umbrella is folded, it will prevent the inside main rib from being accommodated into said middle main rib, and relatively, the outside of said middle main rib and its connected outside joint are inclining slightly outwardly; therefore, it reduces the installation thickness of the terminal joining component, and that after the umbrella is folded, it is naturally configured that the outside joint of each side rib device is located on the inside, and the outside joint of each terminal rib device is naturally located on the outside, to become more narrowed and flattened form.

BRIEF DESCRIPTION OF DRAWINGS

FIG. 4 is the perspective view of the branch rib of side rib of the present invention.

FIG. 4-1 section view taken along the A–A' line in FIG. 4.

FIG. 5 is the perspective view of the branch rib of the terminal rib device of present invention.

FIG. 5-1 is section view along B–B' line in FIG. 5.

FIG. 5-2 is the section view along C≧C' line in FIG. 5.

FIG. 6 is the perspective view of the inside connecting rib in the side rib device and terminal rib device, wherein the solid line indicates the inside connecting rib of side rib device, while the dotted line indicates the inside connecting main rib of terminal rib ice.

FIG. 7 is the perspective view of the main rib and middle main rib of the terminal rib device in the present invention.

FIG. 7-1 is the section view along D–D' line in FIG. 7.

FIG. 8 is the perspective view of assembled inside main rib and middle main rib in the side rib device of the present invention.

FIG. 8-1 is the section view along E–E' line in FIG. 8.

FIG. 10 is the bottom view of the upper ferrule when the present invention of folding umbrella is opened.

DETAILED DESCRIPTION OF THE INVENTION

Figure 1:
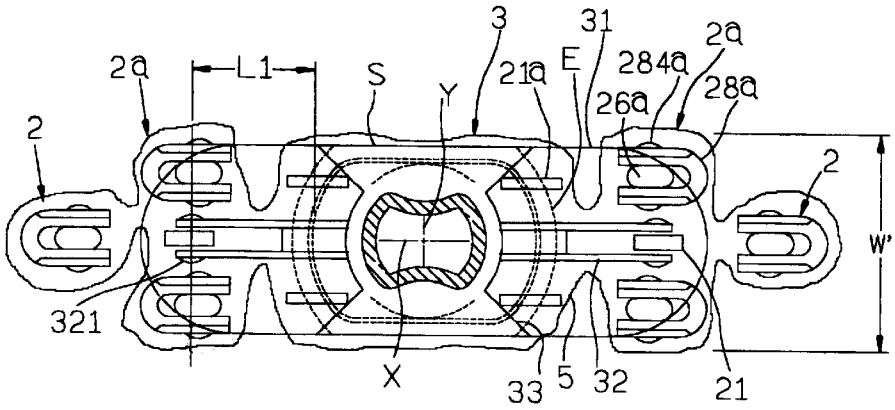
FIG.1 (Prior Art)
FIG. 1 is the top view of a prior art of folding umbrella when it is folded.
Figure 2:
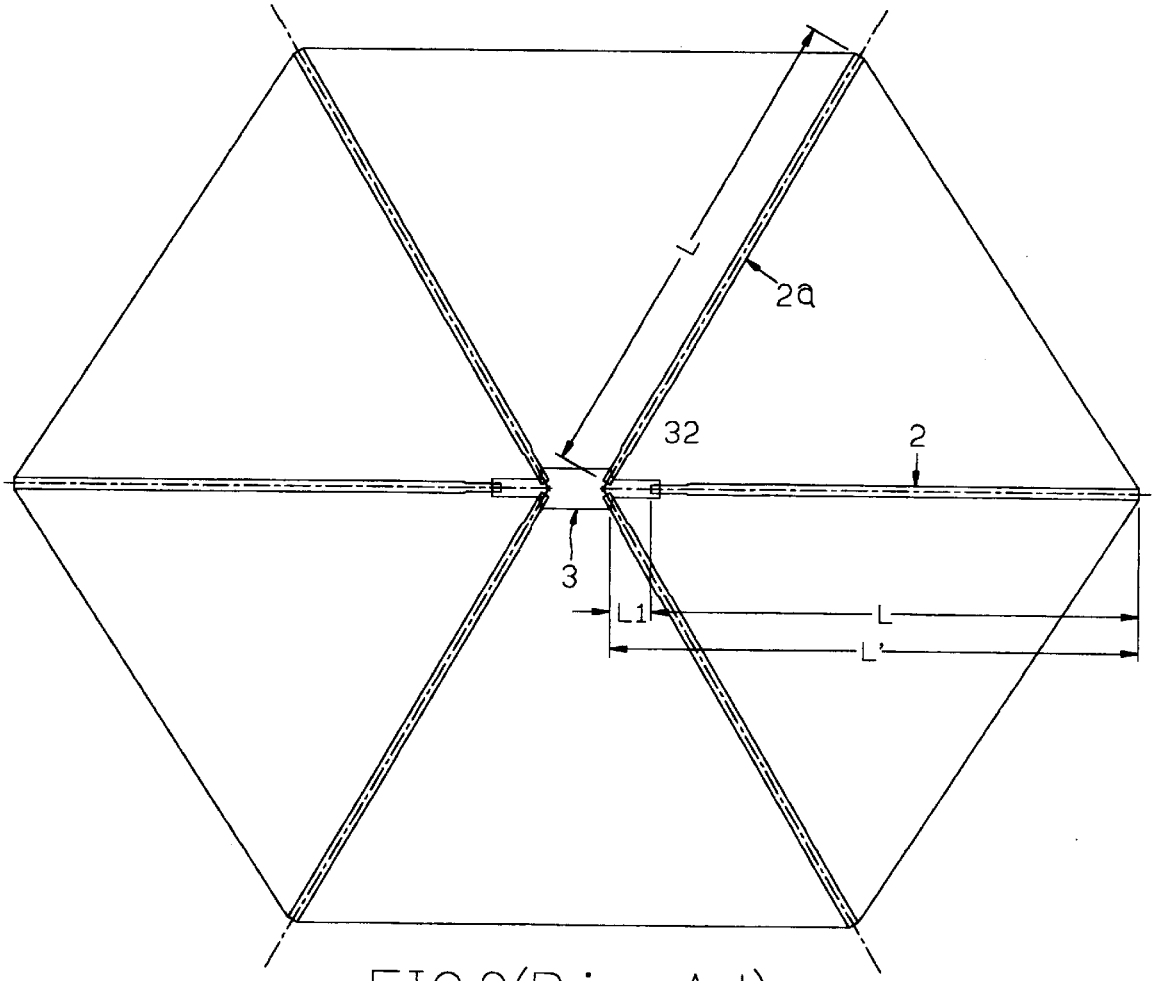
FIG.2(Prior Art)
FIG. 2 is the top view of a prior art of folding umbrella when it is opened.

A preferred embodiment of the present invention can be understood from the following description with drawings.

As illustrated in FIGS. 3 through 10, the present invention comprises: a center rod (1) having an inner tube and an outer tube, an upper ferrule (3) that is fixed to the top of the center rod (1), a lower runner (4) sliding on said center rod (1) and below the upper ferrule (3), a rib assembly comprising two sets of terminal rib device (2) respectively joined to the extremities (E) at the two terminals along the long axis (X) on the upper ferrule (3) and the lower runner (4), and four sets of side rib device (2*a*) respectively joined to the sides (S) on the short axis (Y) on the upper ferrule (3) and the lower runner (4), and a fabric (5) tied to said ribs (2, 2*a*).

Said upper ferrule (3) has a flat plate (31); said flat plate defines a long axis (X) at two extremities (E) and defines a short axis (Y) between two sides (S); said flat plate has a side inclining wall (33) each to its side (S); on said extremity positions are respectively an inserting hole (34); between said terminal position and each side inclining wall (33) is also an inserting hole (34*a*).

Said lower runner (4) has a tube (42) that can slide onto the center rod (1); a flat plate (41) in cross connection with said tube (42); and like the upper ferrule (3), said flat plate defines a long axis between the extremities, and defines a short axis between the two sides; said flat plate has a side inclining wall inclining on respective sides; on said extremity positions are each an inserting hole; between said extremity position and each side inclining wall is also an inserting hole.

Said four sets of side rib device (2*a*) are respectively composed of the inside main rib (21*a*), middle main rib (22*a*), outside main rib (23*a*), branch rib (24*a*), inside connecting rib (25*a*), middle connecting rib (26*a*), middle joint (27*a*) and outside joint (28*a*); in other words, the inside terminal of the inside main rib (21*a*) is joined to the inserting hole (34*a*) of the upper ferrule (3); the outside terminal (212*a*) of the inside main rib (21*a*) is joined to the middle terminal of the middle joint (27*a*), the inside terminal (241*a*) of the branch rib (24*a*) is joined to the inserting hole of the lower runner (4); the outside terminal (242*a*) of said branch rib (24*a*) is joined to near the middle terminal (213*a*) of the inside main rib (21*a*); the inside terminal (251*a*) and the outside terminal (252*a*) of the inside connecting rib (25*a*) are respectively joined approximately to the outside terminal (243*a*) of the branch rib (24*a*) and the terminal (272*a*) of the middle joint (27*a*); said middle joint (27*a*) is directly formed at the inside terminal of the middle main rib (22*a*); the outside terminal (221*a*) of the middle main rib (22*a*) is joined to the middle terminal (281*a*) of the outside joint (28*a*); the inside terminal (261*a*) and outside terminal (262*a*) of the middle connecting rib (26*a*) are respectively approximately joined to near outside terminal (212*a*) of the inside main rib (21*a*) and the inside terminal (282*a*) of the outside joint (28*a*); the outside terminal (283*a*) of the outside joint (28*a*) is joined to the outside main rib (23*a*).

In said side rib device (2), on the inside terminal (211*a*) of the inside main rib (21*a*) and the inside terminal (241*a*) of the branch rib (24*a*) are thread holes (214*a*, 244*a*); also, in said terminal rib device (2), on the inside terminal (211) of the inside main rib (2) and the inside terminal (241*a*) of the branch rib (24) are also thread holes (214, 244); when inside terminals (211*a*, 211) of the inside main rib 21*a*, 21) are inserted in the inserting holes (34*a*, 34) on the upper ferrule (3), an upper tying thread (35) is pulled through the thread holes (214*a*, 214) at the inside terminals (211*a*, 211) of the inside main rib (21*a*, 21), then wound on the thread groove (36) around the upper ferrule, then tied into a knot; likewise, when the inside terminals (241*a*, 241) of the branch ribs (24*a*, 24) are inserted in the inserting holes at the lower runner (4), a lower tying thread (45) is pulled through the thread holes (244*a*, 244), the lower runner (4) and the thread groove (46), then wound into a knot.

The branch rib (24*a*) and the middle main rib (22*a*) of said side rib device (2*a*) are U-shaped ribs each having an U-shaped groove; when the lower runner (4) is pulled down to fold the umbrella, it will sequentially drive all the ribs to fold inwards to the center; the inside connecting rib (25*a*) and the inside main rib (21*a*) can be respectively accommodated in the branch rib (24*a*) and the middle main rib (22*a*), so, in turn, the outside joint (28*a*) and the middle joint (27*a*) will push against the upper ferrule (3) and the lower runner (4).

Said two sets of terminal rib device (2), its rib mechanism and its mutual combination style and said side rib device (2*a*) are exactly the same; in other words, each set of terminal rib device (2) is respectively the mutual combination of the inside main rib (21), the middle main rib (22), the outside main rib (23), the branch rib (24), the inside connecting rib (25), the middle connecting rib (26), the middle joint (27) and the outside joint (28); in other words, the inside terminal (211) of the inside main rib (21) is joined to the inserting hole (34) of the upper ferrule (3), the outside terminal (212) of the inside main rib (21) is joined to the middle terminal (271) of the middle joint (27); the inside terminal (241) of the branch rib (24) is joined to the inserting hole of the lower runner (4); the outside terminal (242) of said branch rib (24) is joined approximately to the middle terminal (213) of the inside main rib (21); the inside terminal (251) and the outside terminal (252) of the inside connecting rib (25) are respectively joined approximately to the outside terminal (243) of the branch rib (24) and the terminal (272) of the middle joint (27); said middle joint (27) is directly formed at the inside terminal of the middle main rib (22); the outside terminal (221) of said middle main rib (22) is joined to the middle terminal (281) of the outside joint (28); the inside terminal (261) and outside terminal (262) of the middle connecting rib (26) are respectively joined to near the outside terminal (214) of the inside main rib (21) and the inside terminal (282) of the outside joint (28); the outside terminal (283) of said outside joint (28) is joined to the outside main rib (23).

However, in the present invention, an appropriate (24), which is branch rib (24), which is originally shaped as an U-shaped groove, is compressed to form a stopper with narrow-opening groove (245) (as shown in FIG. 5 and FIG.

Figure 3:
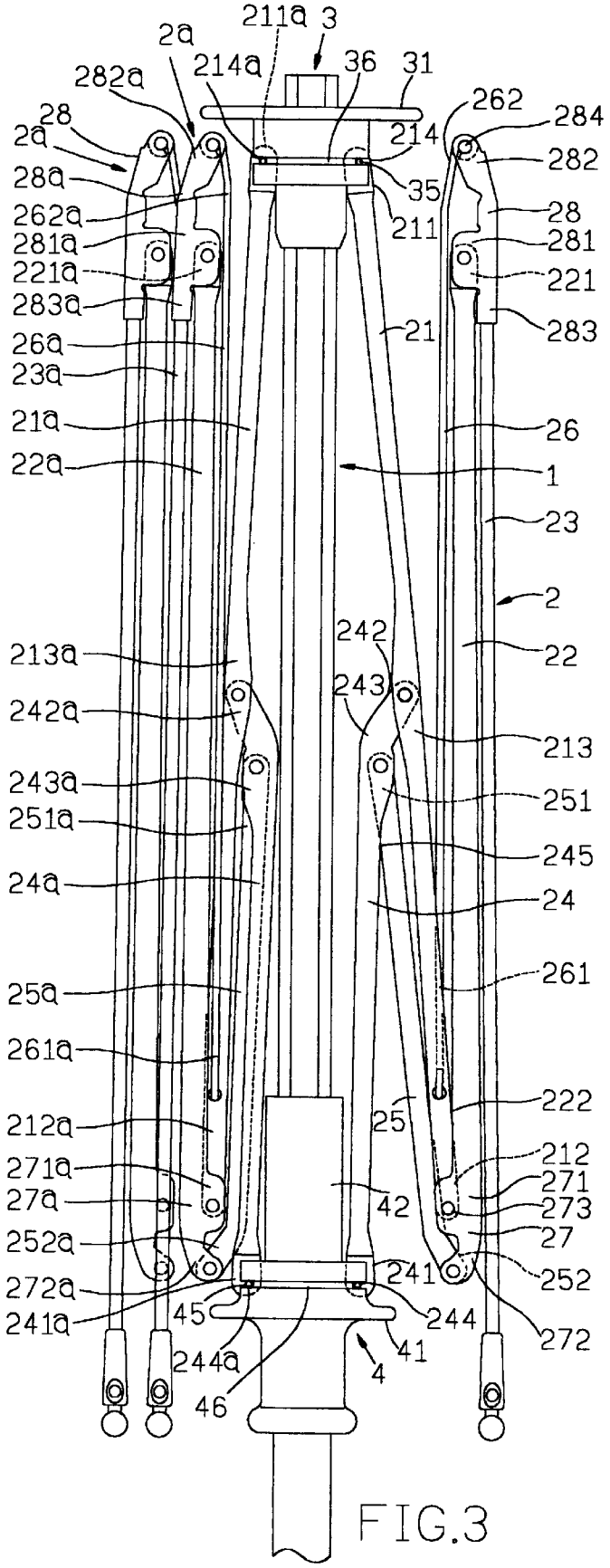
FIG. 3 is the perspective view of the present invention when it is folded, wherein, one side showing its side rib device and terminal rib device; and for the sake of a clear view, the other side showing only the terminal rib device.

5-2), so that when it is folded, the inside connecting rib (25) cannot be accommodated inside said branch rib (24), and the outside terminal (252) of the inside connecting rib (25) and the middle joint (27) connected thereto are inclined relatively outwards (as shown in FIG. 3); besides, the outside terminal (252) of said inside connecting rib (25) is designed to be a larger outwardly inclined obtuse angle (θ) (as shown in FIG. 6), when the umbrella is folded, said outside terminal can be accommodated inside the joint (27), and leaning against the connecting key (273) of the outside terminal (272) of the inside main rib (21) and the middle joint (27), so that the outside terminal (221) of the middle main rib (22) and its connected outside joint (28) are inclined slightly outwardly. As shown in FIG. 7-1, a slightly outward inclination is to be designed on the outside joint (28), or, an appropriate location on the U-shaped groove of the middle main rib (22) is compressed to form a stop of narrow-opening groove (222); when the umbrella is folded, it is used to prevent the inside main rib (21) from being accommodated into said middle main rib (22); so said middle rib (22) will not approach the middle rod (1), and that the outside terminal (221) of said middle main rib (22) and its connected outside joint (28) are inclined slightly outwardly.

Figure 3A:
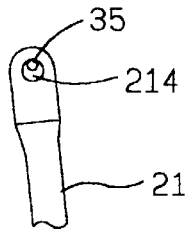
FIG. 3A is the view of a part of the present invention wherein the upper tying thread pulls through the opening on the inside terminal of the inside main rib.
Figure 3B:
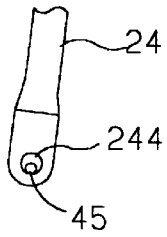
FIG. 3B is the view of a part of the present invention wherein the lower tying thread pulls through the opening on the inside terminal of the branch rib.

However, when the terminal rib umbrella device (2) is folded, the middle joint (27) and the outside joint (28) incline slightly outwardly, they would shorten the distance between the thread hole (214) of the inside main rib (21) and the thread hole (244) of the branch rib (24); but because the distance change is extremely small, and because the diameter of a normal thread hole is 1.8 mm, while the thread diameter of the upper tying thread (35) and the lower tying thread (45) is only 0.8 mm; therefore, the thread will easily be pulled through said thread holes (214, 224) (as shown in FIG. 3A) and FIG. 3B); there will be no problem to fold the umbrella.

Figure 9:
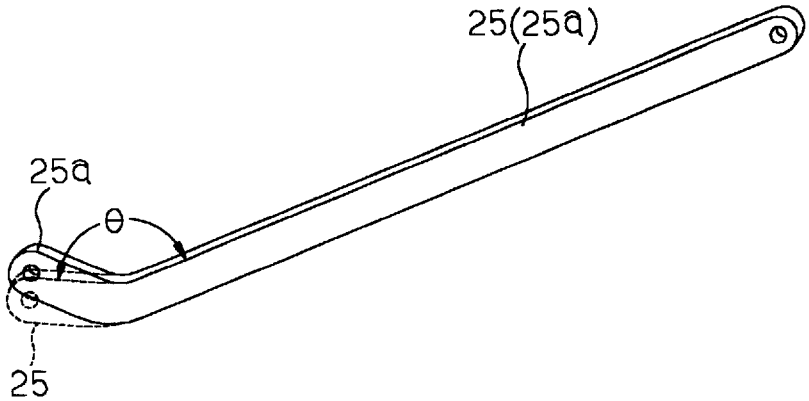
FIG. 9 is the bottom view of the upper ferrule when the present invention of folding umbrella is folded.
Figure 14:
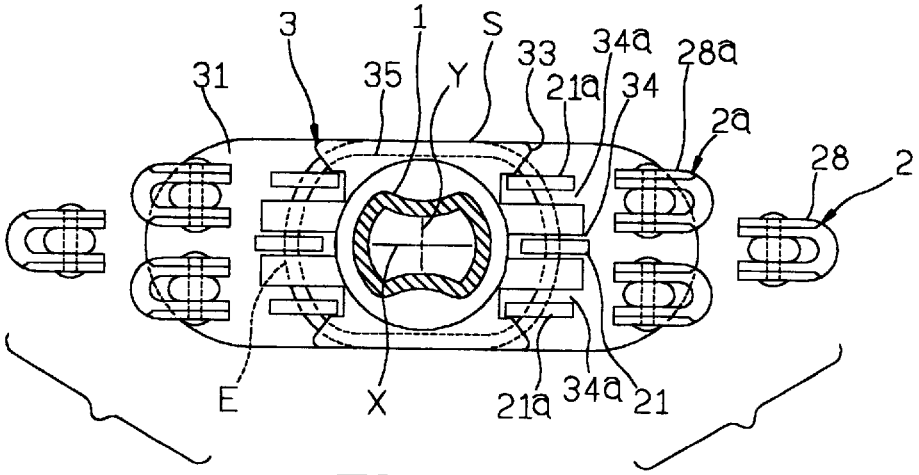
Figure 15:
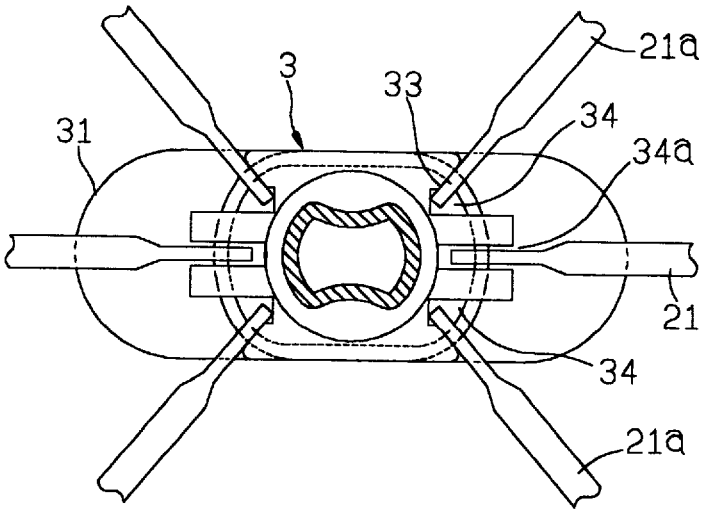

As illustrated in FIGS. 3 and 9, when the umbrella is folded, the four sets of side rib device (2*a*) will naturally incline toward the middle rod (1), the two sets of terminal rib device (2) will naturally incline slightly outwardly, and there will not be the existence of the terminal joining component (32) between the outside joints (28) on two sides of the rib devices (2*a*) as in a prior art; therefore, it will surely narrow the width (w) between two sides of side rib device (2*a*), so the folded umbrella will be flattened. And, in the present invention, because the terminal rib device (2) does not use the terminal joining component (31) as in a prior art, but it is directly installed on the upper ferrule (3) and the lower runner (4), just like the side rib device (2*a*); so that when the umbrella is opened, the extension length of each rib device (2, 2*a*) is in the shape of a equilateral polygon; therefore, the tension strength of the fabric tied onto said ribs is consistent, and the tightness of the fabric is evenly distributed.

The above description covers only a preferred embodiment; the present invention shall include appropriate modifications and variations made within the intent and claim of the present invention.

I claim:

1. A flattened folding umbrella, comprising a center rod composed of a telescoped inner and outer tubes; an upper ferrule fixed on top of the center rod; a lower sliding runner fitted on said center rod and below the upper ferrule; a rib assembly comprising two sets of terminal rib device, respectively joined to the terminal of long-axis terminals to the upper ferrule and the lower runner; and four sets of side rib device that are respectively joined to each side on the short axis near the upper ferrule and the lower runner, and a fabric that is tied on said rib device;

said upper ferrule having a flat plate, said flat plate defining a long axis on two extremities of said flat plate and defining a short axis between two sides; near the sides of said flat plate being side inclining walls; on said extremity positions being respectively inserting holes; between said terminal positions and each side inclining wall being also inserting holes; each set of rib device on said side rib device and extremity rib device having the mutual connection of the inside main rib, middle main rib, outside main rib, branch rib, inside connecting rib, middle connecting rib, middle joint, and outside joint; in which, the inside terminal of the inside main rib being connected to the upper inserting hole; the outside terminal of said inside main rib being joined to the middle terminal of the middle joint; the inside terminal of the branch rib being joined to the inserting hole of the lower runner; the outside terminal of said branch rib being joined to the inside main rib adjacent to a middle portion of said inside main rib; the inside terminal and outside terminal of the inside connecting rib being respectively joined to an outside terminal of the branch rib and a terminal of the middle joint; said middle joint being directly formed at the inside terminal of the middle main rib; the outside terminal of said middle main rib being joined to the middle terminal of the outside joint; the inside terminal and outside terminal of the middle connecting rib being respectively joined to an outside terminal of the inside main rib and an inside terminal of the outside joint; the outside terminal of said outside joint being joined to the outside main rib;

characterized in that: the branch rib having an U-shaped groove compressed to form a narrow-opening groove, so that when the umbrella is folded, the inside connecting rib will not be accommodated inside said narrow-opening groove of said branch rib, so that the outside terminal of said inside connecting rib and its connected middle joint are inclined slightly outwardly; and the outside terminal of said inside connecting rib inclined outwardly, so that when the umbrella is folded, said outside terminal can be accommodated into an interior of the joint, to be retained on the middle joint and the connecting bolt at the outside terminal of the inside main rib, so that the outside terminal of the middle main rib and the outside joint connected therewith will be inclined outwardly.

2. A flattened folding umbrella, according to claim 1, wherein the position of each set of terminal rib is inclined slightly outwardly at the outside joint; and the middle main rib having an U-shaped groove compressed to form a narrow-opening groove to be a stopper, so that when the umbrella is folded, it will stop and prevent the inside main rib from being accommodated in said middle main rib; and that said middle main rib will not approach the middle rod, so that the outside terminal of said middle main rib and the outside joint connected therewith will be inclined slightly outwardly.

* * * * *